United States Patent [19]

Konetzke, Jr.

[11] Patent Number: 4,934,171

[45] Date of Patent: Jun. 19, 1990

[54] HOSE COUPLING MEMBER REPAIR TOOL

[76] Inventor: Howard W. Konetzke, Jr., Rte. 2, Box 248, LaGrange, Tex. 78945

[21] Appl. No.: 268,244

[22] Filed: Oct. 31, 1988

Related U.S. Application Data

[63] Continuation of Ser. No. 155,095, Feb. 11, 1988, abandoned.

[51] Int. Cl.[5] ..... B21D 9/08; B21D 41/00

[52] U.S. Cl. ..... 72/409; 81/302; 81/485; 81/426.5

[58] Field of Search ..... 81/302, 418, 426.5, 81/3.05, 485–488; 7/157; 72/409, 410, 412

[56] References Cited

U.S. PATENT DOCUMENTS 4,553,280 11/1985 Stright ..... 7/157

4,602,496 7/1986 Wagener ..... 81/302

*Primary Examiner*—D. S. Meislin

*Attorney, Agent, or Firm*—Vaden, Eickenroht, Thompson & Boulware

[57] ABSTRACT

A tool for repairing out-of-round coupling members on a garden hose. A pair of essentially identical levers are pivoted together. Each of the levers is configured as a partially cylindrical nose, a curved jaw and an elongated handle. The noses can be inserted in the coupling swivel (female coupling member) or the nipple (male coupling member) can be inserted in openings in the jaws when the handles are moved apart. The coupling swivel or nipple, as applicable, can be partially reshaped with the tool by moving the handles together.

1 Claim, 1 Drawing Sheet

HOSE COUPLING MEMBER REPAIR TOOL

This is a continuation of application Ser. No. 155,095, filed Feb. 11, 1988, now abandoned.

BACKGROUND OF THE INVENTION

This invention relates generally to repairing out-of-round hose coupling members, and, more particularly, to a tool for repairing out-of-round coupling members on a garden hose.

Even the most careful user of a garden hose will discover from time to time that the nipple (male coupling member) of his hose has been stepped on, run over by a car, or otherwise bent out-of-round. Occasionally, such a user may even discover that the coupling swivel (female coupling member) of his hose has been bent out-of-round. If either the nipple or coupling swivel, or both, are bent slightly out-of-round, water leakage is likely to occur. And, of course, the hose will not be useable if either the nipple or coupling swivel, or both, are bent severely out-of-round.

SUMMARY OF THE INVENTION

The present invention provides a tool for repairing out-of-round coupling members on a garden hose.

The tool of the present invention comprises a pair of essentially identical levers pivoted together. Each of the levers is configured as a partially cylindrical nose, a curved jaw and an elongated handle. Thread segments are provided on each of the noses for engaging the internal thread of the coupling swivel (female coupling member) when the noses are inserted therein. Each of the jaws is provided with a partially cylindrical groove or opening that opposes a similar groove or opening in the other jaw. Thread segments are provided in each of said openings for engaging the external thread of the nipple (male coupling member) when the nipple is inserted therein.

When the handles are moved apart, the levers are pivoted to decrease the effective diameter of the noses and move the jaws apart. The noses can then be inserted in a coupling swivel. Alternatively, a nipple can then be positioned between the opposed grooves or openings in the jaws. When the handles are moved together, the levers are pivoted to increase the effective diameter of the noses and move the jaws together to facilitate partial reshaping of the coupling swivel and its internal thread or the nipple and its external thread, as applicable.

These and many other advantages and features of the present invention will be apparent from the following Brief Description of the Drawing, Detailed Description of the Preferred Embodiment and Claims, and the accompanying Drawing.

DETAILED DESCRIPTION OF THE PREFERRED EMBODIMENT

The preferred embodiment of the hose coupling member repair tool of the present invention is shown in FIGS. 1–5.

Figure 1:
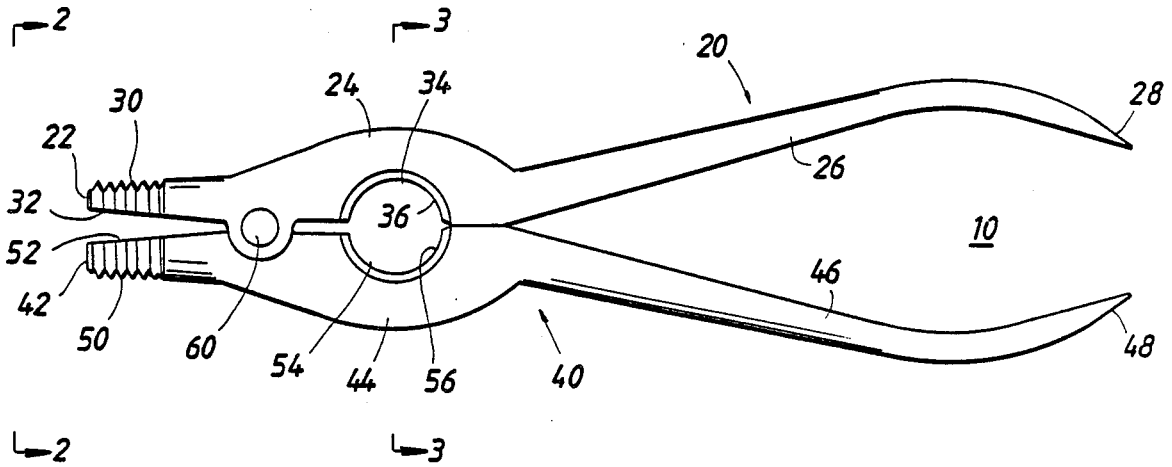
FIG. 1 is a side view of the hose coupling member repair tool of the present invention.
Figure 2:
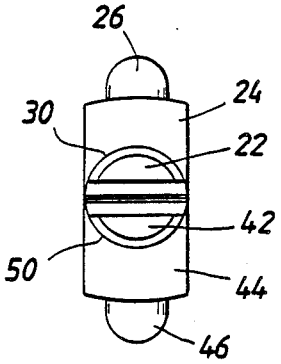
FIG. 2 is a front view of the tool taken along line 2—2 in FIG. 1.
Figure 3:
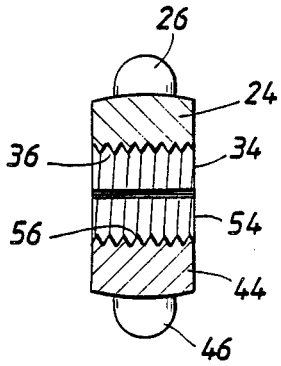
FIG. 3 is a sectional view of the tool taken along line 3—3 in FIG. 1.

Referring first to FIGS. 1–3, tool 10 comprises lever 20 and lever 40 pivoted together in opposed, uncrossed relationship. Pivot pin 60 functions as a common fulcrum for lever 20 and lever 40. Lever 20, lever 40 and pivot pin 60 can be fabricated from any material and by any process that is suitable for the fabrication of similar components of ordinary pliers.

Lever 20 is configured as a partially cylindrical nose 22, curved jaw 24, elongated handle 26 and wedge-shaped pry 28. Lever 40 is essentially a mirror image of lever 20 and is configured as a partially cylindrical nose 42, curved jaw 44, elongated handle 46 and wedge-shaped pry 48.

Noses 22 and 42 are provided with thread segments 30 and 50, respectively, for engaging the internal thread of a coupling swivel (female coupling member) on a garden hose. Flat surfaces 32 and 52 of noses 22 and 42, respectively, are inclined at opposite, equal angles to create an operating gap therebetween.

Jaws 24 and 44 are provided with opposed, partially cylindrical grooves or openings 34 and 54, respectively, having thread segments 36 and 56, respectively, for engaging the external thread of a nipple (male coupling member) on a garden hose. Opposed, flat surfaces 38 and 58 are provided on jaws 24 and 44, respectively, to function as stops when handles 26 and 46 are moved together.

Figure 4:
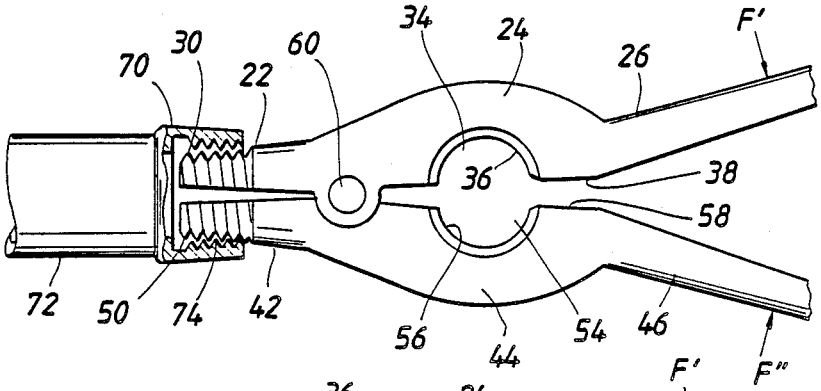
FIG. 4 is a fragmentary side view, in partial section, of the tool and an out of round coupling swivel on a garden hose showing the noses of the tool in position to repair the coupling swivel.

In FIG. 4, tool 10 is being used to repair out-of-round coupling member 70 on water hose 72. Handles 26 and 46 are moved apart to pivot levers 20 and 40, and, thereby, move noses 22 and 42 to partially close the operating gap therebetween. This decreases the effective circumference of noses 22 and 42 to facilitate their insertion in coupling swivel 70.

After insertion of noses 22 and 42, handles 26 and 46 are moved together by the application of forces F′ and F″ to pivot levers 20 and 40, and, thereby, move noses 22 and 42 to open the operating gap therebetween. This increases the effective circumference of noses 22 and 42 to partially reshape coupling swivel 70. Tool 10 can then be rotated around its longitudinal axis to partially reshape internal thread 74.

Figure 5:
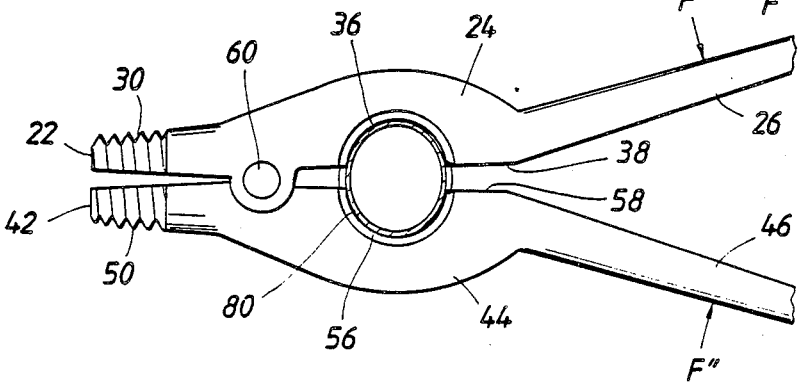
FIG. 5 is a fragmentary side view, in partial section, of the tool and an out-of-round garden hose nipple showing the jaws of the tool in position to repair the nipple.

In FIG. 5, tool 10 is being used to repair out-of-round nipple 80. Handles 26 and 46 are moved apart to pivot levers 20 and 40, and, thereby, move jaws 24 and 44 apart to facilitate insertion of nipple 80 in partially cylindrical openings 34 and 54. After insertion of nipple 80, handles 26 and 46 are moved together to force the nipple to conform to the circular shape of the grooves to thereby restore the nipple to a sufficiently circular shape that it can form a water tight connection with a hose swivel coupling. The tool should be rotated, as required, for the threads on the surface of the grooves to mate with the threads on the nipple before the restoring force is applied to keep the threads from being flattened or otherwise damaged by the force exerted on the nipple by the tool.

If coupling swivel 70 is flattened or otherwise severely out-of-round, noses 22 and 42 cannot be inserted therein as described above. In like manner, nipple 80 cannot be inserted in openings 34 and 54 as described above if it is flattened or otherwise severely out-of-round. In such cases, either pry 28 or pry 48 can be used to open and partially reshape coupling swivel 70 or nipple 80, or both, as may be necessary, prior to use of the appropriate procedure, or procedures, described above.

It is not possible to perfectly reshape coupling swivel 70 and its internal thread 74 and nipple 80 and its external thread 82 with tool 10. However, reshaping to the extent that is necessary for an essentially leak tight coupling is possible so long as an undamaged sealing washer (not shown) is used in coupling swivel 70.

While the present invention has been described and shown in connection with its preferred embodiment, it should be understood that there may be other embodiments that fall within the scope and spirit of the present invention as defined by the following claims.

I claim:

1. A tool for repairing an out-of-round coupling swivel of a water hose comprising a pair of lever arms, means connecting the lever arms intermediate the ends for pivotal movement of the arms around a common axis, each arm being formed with a handle at one end and a noise at the other end having an outer surface lying on the arc of a circle and having a radius of curvature substantially the same as the coupling swivel before it was bent out-of-round, each outer surface being further provided with threads that mate with the internal threads of the swivel coupling when the noses are moved apart by the pivotal movement of the handles toward each other around the common axis and to exert an outward force on the coupling swivel forcing the swivel back to a substantially round shape as the tool is rotated back and forth around the longitudinal axis of the coupling member while the threads on the noses are in mating engagement with the threads of the coupling member to repair the coupling member without damaging the threads of the coupling member, said lever arms being further provided with oppositely facing arcuate surfaces having a radius of curvature equal to the radius of curvatures of the nipple of a hose coupling and threads on the arcutate surfaces that will mate with the threads on the nipple when the handles are moved together around the common pivotal axis and exert a force urging the nipple to a substantially round shape as the tool is rotated back and forth relative to the nipple around the longitudinal axis of the nipple to repair the nipple without damaging the threads of the nipple.

* * * * *